US005489971A

United States Patent [19]

Nam

[11] Patent Number: 5,489,971

[45] Date of Patent: Feb. 6, 1996

[54] METHOD AND APPARATUS FOR DETECTING AN EXCHANGE PERIOD FOR PARTS WITHIN AN ELECTROPHOTOGRAPHIC PRINTING APPARATUS

[75] Inventor: Byung-Deok Nam, Kyungki-do, Rep. of Korea

[73] Assignee: SamSung Electronics Co., Ltd., Kyungki-do, Rep. of Korea

[21] Appl. No.: 249,372

[22] Filed: May 24, 1994

[30] Foreign Application Priority Data

May 25, 1993 [KR] Rep. of Korea ..... 9091

[51] Int. Cl.[6] ..... G03G 21/00

[52] U.S. Cl. ..... 355/208; 355/206; 355/209; 355/260

[58] Field of Search ..... 355/200, 201, 355/203, 204, 206, 260, 208–211; 377/15, 16

[56] References Cited

U.S. PATENT DOCUMENTS

| | | | |
|---|---|---|---|
| 4,105,324 | 8/1978 | Seil | 355/208 |
| 4,136,945 | 1/1979 | Stephens | 355/208 |
| 4,771,313 | 9/1988 | Kuroda et al. | 355/203 |
| 4,774,544 | 9/1988 | Tsuchiya et al. | 377/15 X |
| 4,851,875 | 7/1989 | Tanimoto | 355/211 X |
| 4,860,052 | 8/1989 | Ito et al. | 355/209 |
| 4,870,459 | 9/1989 | Ito et al. | 355/209 |
| 4,961,088 | 10/1990 | Gilliland et al. | 355/206 |
| 5,016,171 | 5/1991 | Connolly et al. | 355/201 X |
| 5,021,828 | 6/1991 | Yamaguchi et al. | 355/209 |
| 5,066,978 | 11/1991 | Watarai et al. | 355/206 |
| 5,101,233 | 3/1992 | Ito et al. | 355/209 |
| 5,115,275 | 5/1992 | Suzuki | 355/245 |
| 5,127,012 | 6/1992 | Hiliger | 371/29.1 |
| 5,196,884 | 3/1993 | Sugiyama et al. | 355/200 |
| 5,200,779 | 4/1993 | Nawata | 355/206 |
| 5,206,685 | 4/1993 | Hara et al. | 355/206 |
| 5,208,626 | 5/1993 | Tanimoto et al. | 355/200 |
| 5,216,464 | 6/1993 | Kotani et al. | 355/208 |
| 5,223,895 | 6/1993 | Saitoh | 355/206 |
| 5,235,384 | 8/1993 | Oka et al. | 355/208 |
| 5,272,503 | 12/1993 | Lesueur et al. | 355/208 |
| 5,276,461 | 1/1994 | Saito | 346/107 R |
| 5,283,613 | 2/1994 | Midgley, Sr. | 355/203 |
| 5,303,005 | 4/1994 | Takano et al. | 355/202 |

*Primary Examiner*—William J. Royer
*Attorney, Agent, or Firm*—Robert E. Bushnell

[57] ABSTRACT

An improved method and apparatus for monitoring the amount of use sustained by a replaceable part within an electrophotographic printing apparatus is disclosed. In response to a print command, a controller reads data from a permanent memory within the replaceable part. The data, which indicates how much use the replaceable part has sustained, is then stored in a buffer within the controller. The data is then incremented by one for each page printed by the printing apparatus. Once the data equals or exceeds a predetermined use value indicative of the operational lifetime of the replaceable part, a user is informed of this condition through a replacement message.

20 Claims, 3 Drawing Sheets

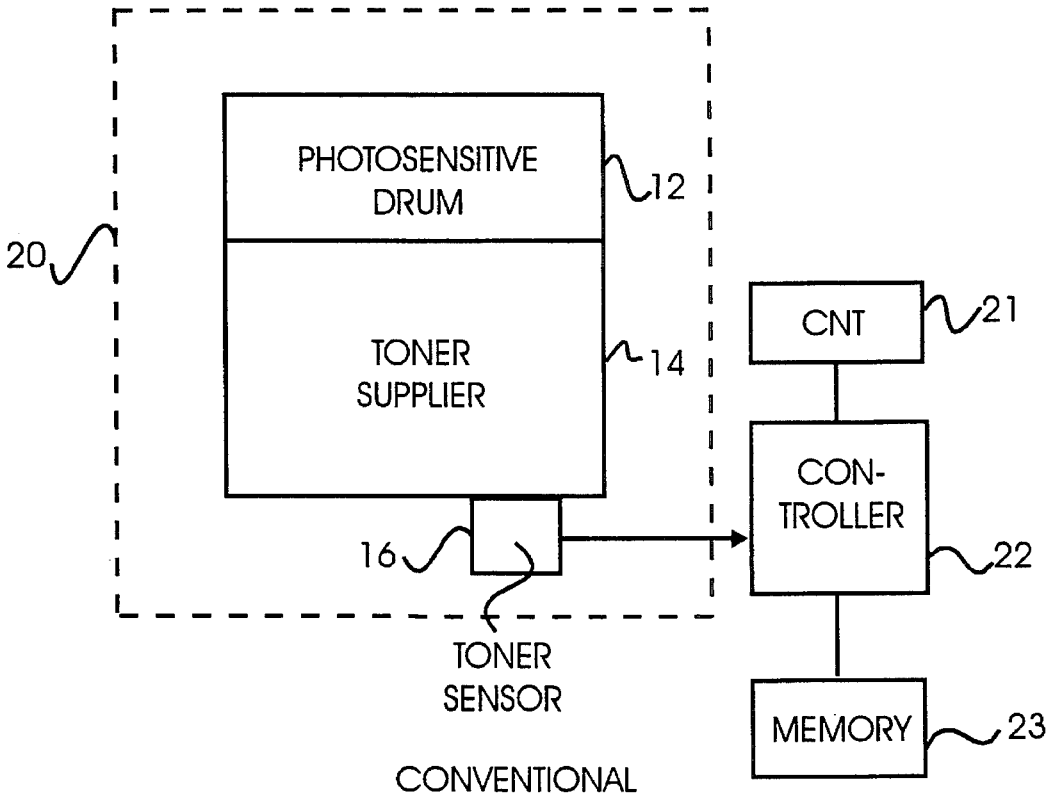
CONVENTIONAL
FIG. 1

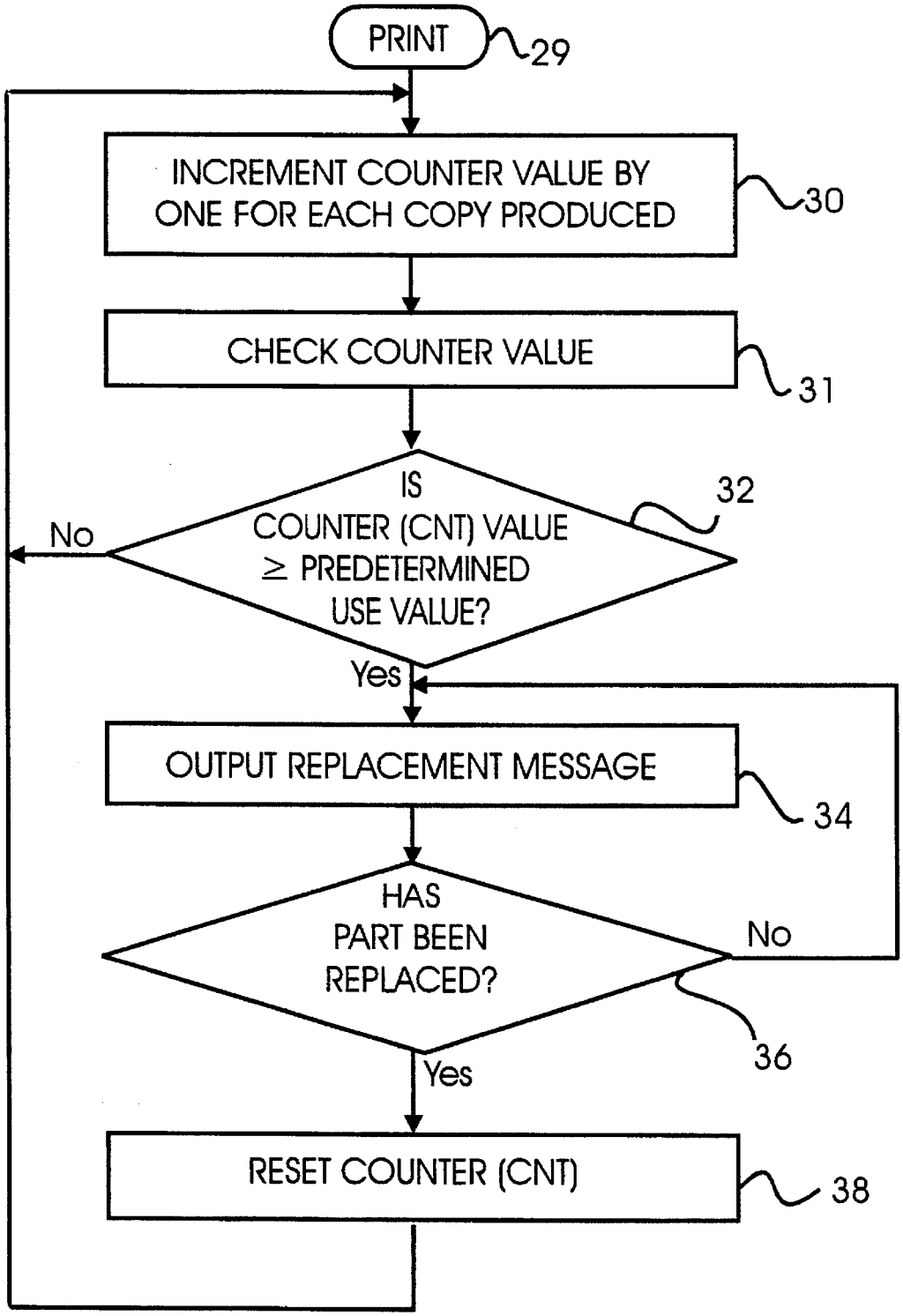
CONVENTIONAL
FIG. 2

METHOD AND APPARATUS FOR DETECTING AN EXCHANGE PERIOD FOR PARTS WITHIN AN ELECTROPHOTOGRAPHIC PRINTING APPARATUS

CROSS REFERENCE TO RELATED APPLICATION

This application makes reference to, incorporates herein and claims all benefits accruing under 35 U.S.C.§119 from our application earlier filed in the Korean Industrial Property Office on 25 May 1993 of our application entitled Method and An Exchange Period Alarm Equipment of Exchangeable Parts Within An Electrophotographic Recording Apparatus, which application was duly assigned Ser. No. 9091/1993.

BACKGROUND OF THE INVENTION

The present invention relates to a method and apparatus for detecting an exchange period for parts within an electrophotographic printing apparatus, and more particularly to a control method and apparatus for sensing when a replaceable part within an electrophotographic printing apparatus has received a requisite amount of use and automatically informing a user of such status.

In electrophotographic printing devices, in order to ensure continuous high quality printing, it is highly recommended that certain parts within the device be replaced after a prescribed amount of use. That is, to ensure high quality printing in a LBP (Laser Beam Printer), LED (Light Emitting Diode) printer, duplicator, facsimile, etc., parts such as the photosensitive drum should be replaced after the printing output of the device reaches a prescribed quantity. There are several replaceable parts within an electrophotographic printing device, including the photosensitive drum, developing unit, etc. Timely replacement of these parts improves copy quality and visibility, and also lengthens the operating life of the device.

Many electrophotographic printing devices include equipment for detecting when the useful life of a given replaceable part has been exceeded. That is, many devices utilize mechanical or electronic counters that detect the number of copies that have been produced using a particular replaceable part. When a counter value equals a predetermined replacement value for the particular replaceable part, a corresponding indication is displayed to the user.

One device utilizing such a concept is disclosed in U.S. Pat. No. 5,216,464 entitled Image Forming Apparatus Having Replaceable Element Which Is Replaced Based On Frequency Of Use, issued to Kotani et al. on 1 Jun. 1993. In this effort, an image forming apparatus includes a replaceable element and a predicting apparatus for predicting the amount of operational life remaining in the replaceable element. The predicting apparatus makes its evaluations on the basis of various calculations. Although the disclosed invention claims to make an accurate prediction as to when an element should be replaced, I believe the process can be simplified so that it is more easily implemented in an image forming apparatus.

Another effort directed at this concept is disclosed in U.S. Pat. No. 5,276,461 entitled Electrophotographic Printing Device, issued to Saito on 4 Jan. 1994. Here, an electrophotographic printing device includes a nonvolatile memory for storing data indicative of the printing history of a photosensitive unit. Saito '461 further discloses that the nonvolatile memory is a removable memory card. Since this nonvolatile memory is not integral with the replaceable photosensitive unit, I have observed that a device constrained according to Saito '461 has potential problems because an accurate printing history may not be maintained if the photosensitive unit is reinstalled into another image forming device without the corresponding nonvolatile memory.

SUMMARY OF THE INVENTION

Therefore, it is an object of the present invention to provide an improved method and apparatus for determining precisely when a replaceable part within an electrophotographic printing apparatus should be replaced.

It is another object to provide replaceable parts for an electrophotographic printing apparatus that contain nonvolatile memory elements which store data indicative of an operational lifetime of the replaceable parts.

It is still another object to promptly inform a user of an electrophotographic printing apparatus of when a particular replaceable part within the apparatus should be replaced.

It is yet another object to provide an electrophotographic printing apparatus that continually produces high quality prints.

To achieve these and other objects, the present invention provides an improved method and apparatus for monitoring the amount of use sustained by a replaceable part within an electrophotographic printing apparatus. In response to a print command, a controller reads data from a permanent memory within the replaceable part. The data, which indicates how much use the replaceable part has sustained, is then stored in a buffer within the controller. The data is then incremented by one for each page printed by the printing apparatus. Once the data equals or exceeds a predetermined use value indicative of the operational lifetime of the replaceable part, a user is informed of this condition through a replacement message.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein:

FIG. 1 is a block diagram of a controller and a replaceable part within a conventional electrophotographic printing apparatus.

FIG. 2 is a flow chart of operation of the controller used in a conventional electrophotographic printing apparatus.

DETAILED DESCRIPTION OF THE PREFERRED EMBODIMENT

Figure 3:
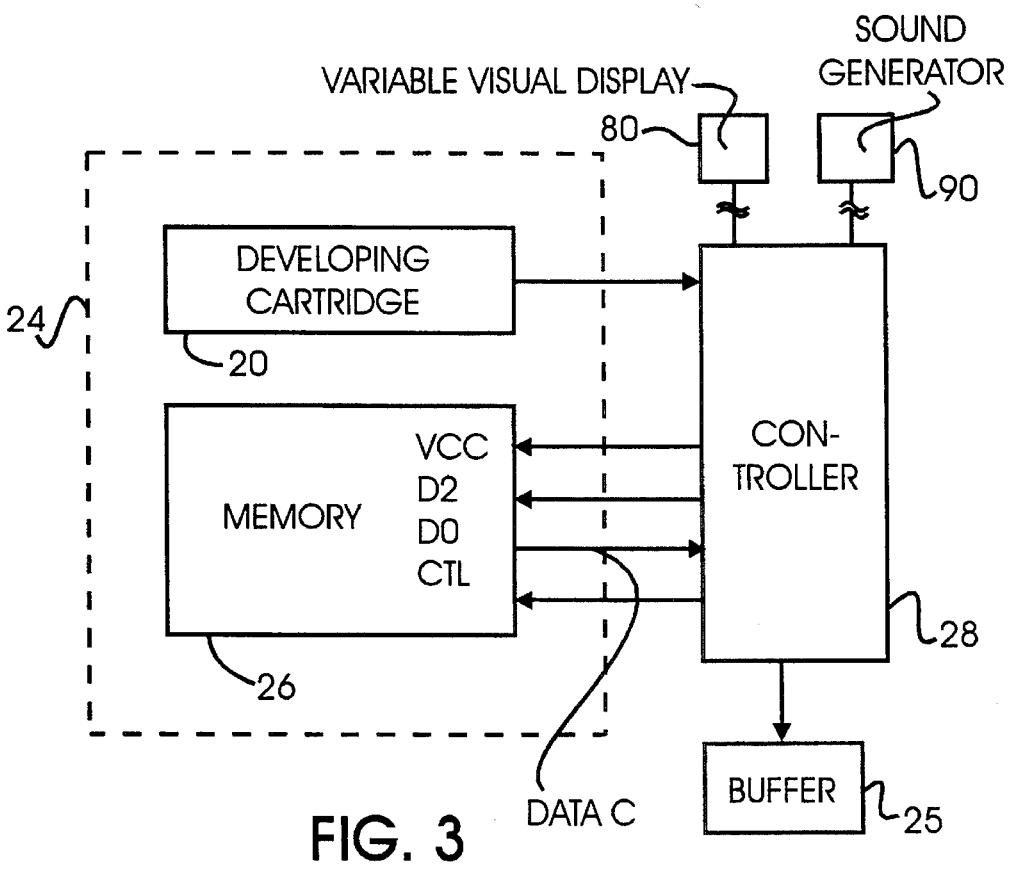
FIG. 3 is a block diagram of a controller and a replaceable part within an electrophotographic printing apparatus constructed according to the principles of the present invention.

FIG. 1 is a block diagram of a controller and a replaceable part within a conventional electrophotographic printing apparatus. Referring to FIG. 1, a developing cartridge 20 (i.e. the replaceable part) includes a photosensitive drum 12, a toner supplier 14 for supplying toner to photosensitive drum 12, and a toner sensor 16 for detecting the amount of toner remaining in toner supplier 14. FIG. 1 also shows a controller 22 for determining the number of copies that have been produced by the printer while developing cartridge 20 has been in use. Controller 22 outputs a replacement message when developing cartridge 20 has been used to produce a predetermined number of copies. Controller 22 includes a counter portion (CNT) 21 and a memory portion 23.

In FIG. 1, controller 22 counts the number of copies produced using developing cartridge 20, analyzes a toner volume detection signal output from toner sensor 16, perceives how much toner remains in toner supplier 14, and outputs a corresponding message.

FIG. 2 is a flow chart of operation of controller 22 used in a conventional electrophotographic printing apparatus. Referring to FIGS. 1 and 2, the following describes operations for detecting when a particular part should be replaced within a conventional electrophotographic printing apparatus. When the printing apparatus performs a print command, m controller 22 activates developing cartridge 20 to initiate the printing process in step 29. In step 30, a counter portion CNT 21 of controller 22 is incremented by one for each copy produced during the printing process. Controller 22 then checks the value of counter CNT 21, in step 31. This value, representing the number of copies which have been produced with developing cartridge 20, is also stored in a memory portion 23 of controller 22 in step 31. Next, controller 22 compares the stored counter value with a predetermined use value also stored in memory portion 23. The predetermined use value represents the number of copies developing cartridge 20 can produce before replacement is suggested. In step 32, controller 22 determines whether or not the counter value is equal to the predetermined use value. If the counter value is below the predetermined use value for developing cartridge 20, controller 22 returns to step 30. In the above description, the predetermined use value for a particular part is specified by manufacturers of the part.

If the counter value is below the predetermined use value and printing is continued, the counter value is again incremented by one for each copy produced. When the counter value becomes greater than or equal to the predetermined use value in step 32, controller 22 provides a replacement message to the user through a display device (not shown in FIG. 1) in step 34 indicating that the user should replace developing cartridge 20. In step 36, controller 22 then detects whether or not the part (i.e. developing cartridge 20) has been replaced. The replacement message continues to be displayed until replacement has been performed. Once replacement has been performed, counter CNT 21 is reset in step 38, The conventional method and apparatus described above have several drawbacks. One of these drawbacks occurs when developing cartridge 20 is reinstalled for use in another electrophotographic printing apparatus. In such cases, it is virtually impossible to keep track of how much use the part has endured prior to reinstallation. Say for example, developing cartridge 20, which had been used in electrophotographic printing apparatus A (Set A) to produce a given number of copies, is then reinstalled for use in electrophotographic printing apparatus B (Set B). Since the amount of use incurred by developing cartridge 20 in Set A is stored in controller 22, and controller 22 is installed within Set A, there is no way to detect how much developing cartridge 20 has been used before it is installed in Set B. Accordingly, there is much uncertainty in determining the operative lifetime of developing cartridge 20 after it is installed in Set B.

In the following description, many specific details are set forth to provide a more thorough and complete understanding of the present invention. It will be apparent, however, to those skilled in the art, that the present invention may be practiced without these specific details. In other instances, well known circuits have not been described so as not to obscure the present invention.

FIG. 3 is a block diagram of a controller and a replaceable part within an electrophotographic printing apparatus constructed according to the principles of the present invention. FIG. 3 shows a developing unit 24 (i.e. the replaceable part) and a controller 28. Developing unit 24 includes developing cartridge 20 (as described above in conjunction with FIG. 1) and a memory 26 (preferably a nonvolatile memory such as an EEPROM, i.e. Electrically Erasable Programmable Read Only Memory) for permanently storing data C indicative of the amount of use sustained by developing unit 24. Controller 28 reads data C from memory 26 in response to a print command. A counter value (same as described above in conjunction with FIGS. 1 and 2) indicated by data C is increased by one in response to each copy printed. If data C indicates a counter value that exceeds the predetermined use value for developing unit 24, the user is informed. Controller 28 includes a buffer portion 25 for storing the predetermined use value of developing unit 24 (or other replaceable part to which controller 28 is connected) and data C (i.e. counter value) read from memory 26.

Figure 4:
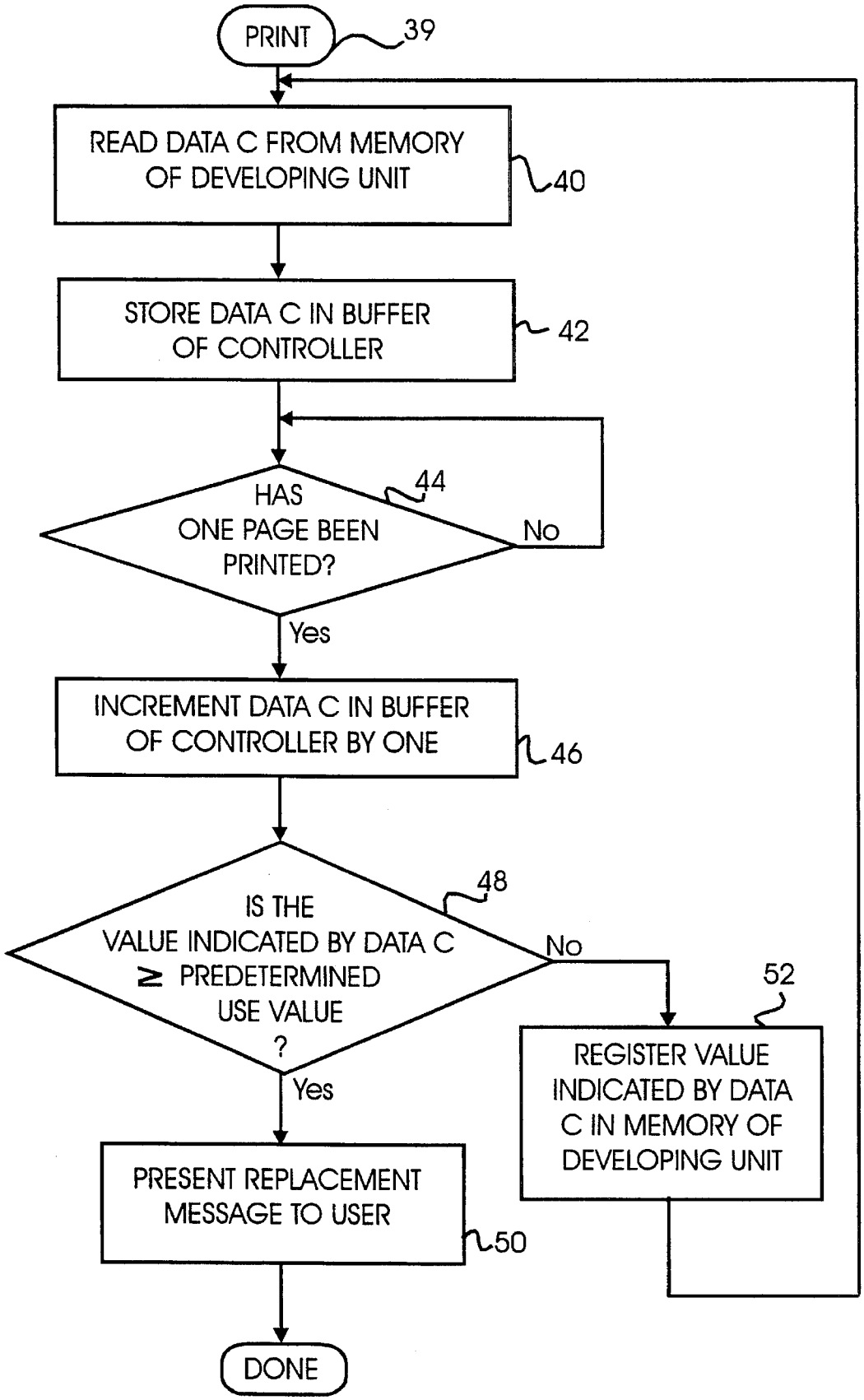
FIG. 4 is a flow chart of operation of the controller used in the electrophotographic printing apparatus constructed according to the principles of the present invention.

FIG. 4 is a flow chart of operation of controller 28 used in the electrophotographic printing apparatus constructed according to the principles of the present invention. Briefly, FIG. 4 describes the following. In response to a print command, data C indicative of a counter value of developing unit 24 is read from memory 26. Data C is then stored in buffer portion 25 of controller 28. Next, data C stored in buffer portion 25 is incremented by one when a single page is printed. Then the value indicated by data C is compared to the predetermined use value for developing unit 24. If the value indicated by data C is greater than or equal to the predetermined use value for developing unit 24, a replacement message is displayed to the user. If the value indicated by data C is not greater than or equal to the predetermined use value for developing unit 24, the value indicated by data C is registered into memory 26 of developing unit 24, and the process is repeated.

Referring to FIGS. 3 and 4, the following is a detailed description of one embodiment of the present invention. During operation of an electrophotographic printing apparatus having developing unit 24 (i.e. the replaceable part) and controller 28 shown in FIG. 3, controller 28 detects when a print command has been input by a user. Before the print command is input, controller 28 remains in a stand-by state. Upon input of the print command, in step 39 controller 28 begins to activate developing unit 24. In step 40, controller 28 outputs a source voltage to a power terminal Vcc and a read control signal to a control terminal CTL to initiate a read operation. Power terminal Vcc and control terminal CTL are input ports of memory 26 installed within developing unit 24. Controller 28 reads data C from data output terminal DO of memory 26. Data C is in the form of a counter value indicating the number of printed sheets developing unit 24 has ever produced.

In step 42, controller 28 stores data C in buffer 25. Notwithstanding the block diagram structure depicted in FIG. 3, buffer 25 is an internal portion of controller 28. Then, in step 44, controller 28 detects when a single page has been printed. When a single page has been printed, controller 28 proceeds to step 46 where the counter value (indicated by data C) stored in buffer 25 is incremented by one. Here, even though the counter value is incremented by one following the print operation, the counter value can be incremented just before the print operation without departing from the principles of the present invention. Next, in step 48, controller 28 determines whether the counter value indicated by data C is greater than or equal to the predetermined use value for developing unit 24. If the counter value indicated by data C is greater than or equal to the predetermined use value for developing unit 24, controller 28 enables output of a replacement message for developing unit 24. This replacement message is presented by a variable visual display 80 in step 50 to inform the user that developing unit 24 should be replaced. Alternatively, the replacement message may be presented by an audible signal using sound generator 90. If, in step 48, the counter value indicated by data C is not greater than or equal to the predetermined use value for developing unit 24, controller 28 proceeds to step 52 where the counter value indicated by data C is registered in memory 26 of developing unit 24 through input line D2. Following step 52, controller 28 proceeds back to step 40 to repeat the above described steps.

In the above description, developing unit 24 has been presented, by way of example, as the replaceable part being monitored. However, it will be clear to those skilled in the art that the method described above can be applied to any replaceable part within an electrophotographic printing apparatus without departing from the spirit and scope of the present invention.

In general, a replaceable part has an operational life capable of printing several thousands through several tens of thousands of papers. Hence, even though there is a comparing step prior to an incremented step, the same result is substantially obtained in the practice of the foregoing principles.

In summary, the present invention provides an improved method and apparatus for monitoring the amount of use sustained by a replaceable part within an electrophotographic printing apparatus. In this method, controller 28 first reads, in response to a print command, data indicative of how much use a particular replaceable part has sustained. This data is then stored in buffer 25 within controller 28. The data is then incremented by one for each page printed by the printing apparatus. Once the data equals or exceeds a predetermined use value indicative of the operational lifetime of the replaceable part, a user is informed of this condition through a replacement message.

In the present invention, a memory which permanently stores data relating to the amount of use sustained by a particular replaceable part, is installed within the replaceable part in an electrophotographic printing apparatus. Accordingly, the present invention is capable of providing high quality prints since the user is informed of when particular parts within the printer need to be replaced.

What is claimed is:

1. An apparatus for monitoring an amount of use sustained by a replaceable part within an electrophotographic printing device, said apparatus comprising:

first storage means permanently installed within said replaceable part for storing use data indicative of the amount of use sustained by said replaceable part, said replaceable part having a fixed operational lifetime;

means for incrementing said use data stored in said first storage means, said use data being incremented by one in response to each page printed by said electrophotographic printing device;

second storage means for storing predetermined replacement data, said predetermined replacement data indicative of how much use said replaceable part should sustain before replacement; and control means for comparing a value indicated by said use data stored in said first storage means with a value indicated by said predetermined replacement data stored in said second storage means, said control means informing a user that said fixed operational lifetime of said replaceable part has expired when said value indicated by said use data one of exceeds and equals said value indicated by said predetermined replacement data.

2. The apparatus claimed in claim 1, wherein said value indicated by said use data is registered in said first storage means when said value indicated by said use data does not one of exceed and equal said predetermined replacement data.

3. The apparatus claimed in claim 2, wherein said first storage means is a nonvolatile electrically erasable programmable read only memory.

4. The apparatus claimed in claim 1, wherein said replaceable part is one of a photosensitive drum and a developing unit.

5. The apparatus as claimed in claim 1, further comprised of said second storage means being permanently installed within said control means.

6. The apparatus as claimed in claim 1, further comprised of said control means for comparing said value indicated by said use data stored in said first storage means with said value indicated by said predetermined replacement data stored in said second storage means after each said page printed.

7. The apparatus as claimed in claim 6, further comprised of said first storage means of said replaceable part storing and maintaining a current state of said use data when said replaceable part is removed from said electrophotographic printing device and reinstalled into another printing device.

8. The apparatus as claimed in claim 1, further comprised of said first storage means of said replaceable part storing and maintaining a current state of said use data when said replaceable part is removed from said electrophotographic printing device and reinstalled into another printing device.

9. A method for monitoring an amount of use sustained by a replaceable part within an electrophotographic printing apparatus, said method comprising the steps of:

reading use data indicative of the amount of use sustained by said replaceable part from a memory portion within said replaceable part in response to a print command;

increasing a value indicated by said use data by one for each page printed in response to said print command;

comparing, after each said page printed, said value indicated by said use data with a predetermined replacement value, said predetermined replacement value indicating a number of pages that can printed by said electrophotographic printing apparatus before said replaceable part should be replaced; and informing a user that said replaceable part should be replaced when said value indicated by said use data one of exceeds and equals said predetermined replacement value.

10. The method claimed in claim 9, further comprising a step of storing said value indicated by said use data in said memory portion within said replaceable part when said value indicated by said use data does not one of exceed and equal said predetermined replacement value.

11. The method claimed in claim 9, wherein said step of informing the user is performed by displaying a replacement message on a variable visual display.

12. The method claimed in claim 9, wherein said step of informing the user is performed by producing an audible signal through sound generation means.

13. The method claimed in claim 9, wherein said memory portion within said replaceable part comprises a nonvolatile electrically erasable programmable read only memory.

14. The method as claimed in claim 9, further comprising a step of removing said replaceable part from said electrophotographic printing apparatus and reinstalling said replaceable part into another printing apparatus while maintaining a current state of said use data.

15. A method for monitoring an amount of use sustained by a replaceable part within an electrophotographic printing apparatus, said method comprising the steps of:

reading use data indicative of the amount of use sustained by said replaceable part from a memory portion within said replaceable part in response to a print command and storing said use data in a control buffer;

incrementing a value indicated by said use data by one for each page printed in response to said print command;

comparing, after each said page printed, said value indicated by said use data with a predetermined replacement value, said predetermined replacement value indicating a number of pages that can printed by said electrophotographic printing apparatus before said replaceable part should be replaced; and storing said value indicated by said use data in said memory portion within said replaceable part when said value indicated by said use data does not one of exceed and equal said predetermined replacement value.

16. The method claimed in claim 15, further comprising a step of informing a user that said replaceable part should be replaced when said value indicated by said use data one of exceeds and equals said predetermined replacement value.

17. The method claimed in claim 16, wherein said step of informing the user is performed by displaying a replacement message on a variable visual display.

18. The method claimed in claim 16, wherein said step of informing the user is performed by producing an audible signal through sound generation means.

19. The method claimed in claim 15, wherein said memory portion within said replaceable part comprises a nonvolatile electrically erasable programmable read only memory.

20. The method as claimed in claim 15, further comprising a step of removing said replaceable part from said electrophotographic printing apparatus and reinstalling said replaceable part into another printing apparatus while maintaining a current state of said use data.

* * * * *

UNITED STATES PATENT AND TRADEMARK OFFICE

CERTIFICATE OF CORRECTION

PATENT NO. : 5,489,971

DATED : February 6, 1996

INVENTOR(S) : Byung-Deok Nam

It is certified that error appears in the above-indentified patent and that said Letters Patent is hereby corrected as shown below:

| | | |
|---|---|---|
| Column 2, | Line 67, | after "12" , change period "." to comma --,--; and |
| Column 4, | line 55, | delete "," after command. |
| Column 4, | Line 55, | after "39", insert comma --,--: |

Signed and Sealed this

Twenty-fourth Day of June, 1997

Bruce Lehman

*Attest:*

BRUCE LEHMAN

*Attesting Officer*

*Commissioner of Patents and Trademarks*